US005562282A

United States Patent [19]

Stevenson

[11] Patent Number: 5,562,282

[45] Date of Patent: Oct. 8, 1996

[54] BALL PITCHING DEVICE

[76] Inventor: Gregg N. Stevenson, 430 Milsaps Rd., Statesville, N.C. 28677

[21] Appl. No.: 295,293

[22] Filed: Aug. 24, 1994

[51] Int. Cl.[6] ..... A63B 69/40

[52] U.S. Cl. ..... 273/26 D; 124/7; 124/16

[58] Field of Search ..... 273/26 D, 29; 124/7, 16

[56] References Cited

U.S. PATENT DOCUMENTS

| | | | |
|---|---|---|---|
| 2,696,204 | 12/1954 | Gilgoff | 124/7 |
| 3,572,708 | 5/1969 | Smith | 124/7 |
| 4,015,578 | 4/1977 | Wright | 124/7 |
| 4,269,162 | 5/1981 | Abraham | 124/7 |
| 4,345,577 | 8/1982 | Andersson | 124/16 |
| 4,391,264 | 7/1983 | Abraham | 124/7 |

*Primary Examiner*—Theatrice Brown
*Attorney, Agent, or Firm*—Petree Stockton, LLP

[57] ABSTRACT

A ball pitching device includes a pivotable pitching arm spring biased in a ball pitching direction by a spring and pivoted in a direction opposite the ball pitching direction by a rotating member engaging a cam surface of the pitching arm. The pitching arm is pivoted to a ball engaging position, and a ball to be pitched is delivered from a ball chamber for engagement by the pitching arm. After the ball is delivered for engagement by the pitching arm, the rotating member disengages the pitching arm cam surface allowing the spring to return the pitching arm toward the stop position engaging and propelling the ball in the ball pitching direction.

8 Claims, 3 Drawing Sheets

BALL PITCHING DEVICE

FIELD OF THE INVENTION

The present invention relates to ball pitching devices for batting practice, fielding practice and the like, and more particularly to a new and improved device for pitching a ball such as a softball utilizing a spring biased pivotable pitching arm which simulates a manual underarm manner of pitching the ball.

DESCRIPTION OF THE PRIOR ART

Various types of devices for pitching or throwing a ball at a relatively high velocity in a substantially flat trajectory have been used in the past, and various types of such devices have been heretofore used for pitching or throwing curve balls by imparting spin on the ball.

While such devices may simulate a hard overhand baseball pitch or the like, in a sport such as softball, the ball is not generally thrown at a high velocity in a flat trajectory, and spin is not generally imparted to the ball to cause the ball to curve.

Many of such devices utilize the rapidly moving surface of a motor driven rotating wheel either by introducing a ball into the space defined between the moving surface of the rotating wheel and a fixed surface or by manually introducing the ball into a space defined between the moving surface of the rotating wheel and the moving surface of a second motor driven rotating wheel to propel the ball. Generally, such devices are of a complex design, are not readily portable, and are costly to make and maintain. Moreover, it is necessary to have a person manually feed the balls, and the rapidly rotating wheel or wheels used in such devices may present an unacceptable safety hazard. Further, many of such devices require a source of 110 volt alternating current to operate, which requires that such devices be connected by means of an electric cable to an electrical outlet or to a generator which must be powered, for example, by an internal combustion engine such as a gasoline engine. Such devices create a potential hazard with respect to the connecting electric cable, and the noise and air pollution associated with a gasoline engine powered electric generator are objectionable.

There is a current need to provide a device for pitching a ball, such as a softball, which simulates a manual underarm manner of pitching the ball that is of a relatively simple design which is inexpensive to make and maintain and which does not require an external power source, may be operated remotely, is readily portable, and safe to use.

The present invention addresses this need and provides a ball pitching device which can be used for batting practice, fielding practice and the like using a spring biased pitching arm which simulates a manual style of pitching the ball and which is of a simple design, is inexpensive to make and maintain, is readily portable, may be operated remotely, and is safe to use.

SUMMARY OF THE INVENTION

The general purpose of the present invention, which will be described subsequently in greater detail, is to provide a new and improved device for pitching a ball having a spring biased pivotable pitching arm which has all of, and more than, the advantages of prior art ball pitching or throwing devices and none of the disadvantages.

To attain this purpose, representative embodiments of the present invention are illustrated in the drawings. The ball pitching device of the present invention makes use of a frame supporting a pitching arm pivoted to the frame and pivotable between a stop position and a pitching arm ball engaging position. The pitching arm is urged in a ball pitching direction toward the pitching arm stop position by a pitching arm tension spring connected between the pitching arm and the frame and is pivoted by a rotary member rotatably supported on the frame having a rotation axis spaced from the pitching arm pivot axis.

The pitching arm is provided with a cam surface, and the rotary member engages the pitching arm cam surface pivoting the pitching arm from the pitching arm stop position to the pitching arm ball engaging position for engagement of a ball to be pitched by the pitching arm. Upon delivery of the ball for engagement by the pitching arm, the pitching arm is released by the rotary member, allowing the tension spring to return the pitching arm toward the stop position engaging and propelling the ball in the ball pitching direction.

Preferably, the rotary member has opposing ends and is rotated by a battery powered electric motor provided with a rotation shaft to which the rotary member is connected. The electric motor is activated initially by a manual switch to rotate the electric motor rotation shaft and connected rotary member. The manual switch may be a foot operated switch spaced from and connected to the electric motor by an electric cable for remote operation. The manual foot operated switch is depressed and, after the rotating member commences rotating for approximately one-half second, the rotating member engages a rotation responsive cycle switch which keeps the electric motor activated and the rotating member rotating, and the foot switch may be released. After rotating substantially 180 degrees, the rotary member disengages the rotation responsive electrical switch which deactivates the electric motor.

Upon activation, the electric motor rotation shaft and connected rotary member moves one of the opposing rotary member ends from a pre-engaged position of the rotary member end proximate the pitching arm in the pitching arm stop position to engage the pitching arm cam surface and pivot the pitching arm to the pitching arm ball engaging position.

A ball chamber is supported on the frame for receiving and delivering a ball for engagement by the pitching arm in the pitching arm engaging position. The ball chamber has an exit with a normally closed battery powered electric solenoid gate normally retaining the received ball in the ball chamber. The ball chamber exit gate is operable by a pitching arm pivotal movement responsive electrical switch disposed to be engaged by the pitching arm in the pitching arm ball engaging position which activates the exit gate to an open position allowing the ball to advance from the ball chamber for engagement by the pitching arm in the pitching arm ball engaging position. As the rotary member continues to be rotated by the electric motor rotation shaft, the rotary member end disengages the pitching arm cam surface releasing the pitching arm allowing the tension spring to return the pitching arm toward the pitching arm stop position engaging and propelling the ball in the ball pitching direction.

A ball magazine communicating with the ball chamber is provided for receiving one or more succeeding balls to be advanced to the ball chamber. The ball chamber is provided with an entrance having a normally open electric solenoid entrance gate, and a succeeding ball received in the ball magazine is normally retained against advancement to the ball chamber by the preceding ball which is retained in the ball chamber by the normally closed ball chamber exit gate. Simultaneously with activation of the ball chamber exit gate from a closed position to an open position to allow the preceding ball to advance from the ball chamber to be engaged by the pitching arm, the pivotal movement responsive electrical switch activates the ball chamber entrance gate from an open position to a closed position retaining the succeeding ball in the ball magazine.

When the rotary member end disengages the pitching arm cam surface releasing the pitching arm, the pitching arm pivotal movement responsive electrical switch is likewise disengaged by the pitching arm, deactivating the ball chamber entrance gate to the normally open position allowing the succeeding ball to advance from the ball magazine to the ball chamber and simultaneously deactivating the ball chamber exit gate to the normally closed position retaining the succeeding ball in the ball chamber. After disengaging the pitching arm, the rotary member is rotated by the electric motor rotation shaft until the rotary member disengages the rotary member rotation responsive cycle switch to deactivate the electric motor with the other of the opposing rotary member ends disposed in the pre-engaged position proximate the pitching arm in the pitching arm stop position.

A channel member having an arcuate inner surface is disposed proximate the ball chamber for receiving the ball from the ball chamber for engagement by the pitching arm. The pitching arm may be provided with a rigid arm portion and spring arm portion to which a pitching arm cup having a concave inner surface is affixed. Preferably, a stop member mounted on a compression spring and having a rubber head is affixed to the frame for engagement by the pitching arm in the pitching arm stop position. Further, the pitching arm may have a shock absorbing member which engages the stop member in the pitching arm stop position.

For ease of transport and portability, the frame may be provided on one side with two pairs of opposing wheels, and as a safety measure, a pressure actuated position switch normally overriding the electric motor activating switch to deactivate the electric motor can be provided on a side adjacent the wheeled side, preventing unintentional activation of the electric motor. Additionally, as a further safety measure, an emergency stop switch normally overriding the electrical motor activating switch to deactivate the electric motor may be provided. Also, the ball chamber may be provided with a ball chamber switch deactivating the electric motor unless a ball is received in the ball chamber.

This outline focuses on the more important features of the invention in order that a detailed description which follows may be better understood and in order that the present contribution to the art may be better appreciated. There are, of course, additional features of the invention that will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and being carried out in various ways.

It is to be further understood that the phraseology and terminology employed herein are for the purpose of description and are not to be regarded as limiting. Those skilled in the art will appreciate that the conception upon which this disclosure is based may readily be utilized as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved ball pitching device utilizing a spring biased pitching arm which simulates a manual style of pitching the ball and at the same time overcoming the structural complications and excessive costs associated with prior art devices.

It is another object of the present invention to provide a new and improved design of the type described that is more reliable, functional and safe to operate and maintain than those presently available.

These, together with other objects of the present invention, along with the various features of novelty which characterize the invention, are pointed out with particularity in the claims annexed to and forming a part of this disclosure. For a better understanding of the invention, its operating advantages, and the specific objects attained by its uses, reference should be made to the accompanying drawings in which like characters of reference designate like parts throughout the several view.

BRIEF DESCRIPTION OF THE DRAWINGS

The invention will be better understood and objects other than those set forth above will become apparent when consideration is given to the following detailed description. Such description makes reference to the annexed drawings wherein.

DESCRIPTION OF THE PREFERRED EMBODIMENT

Figure 1:
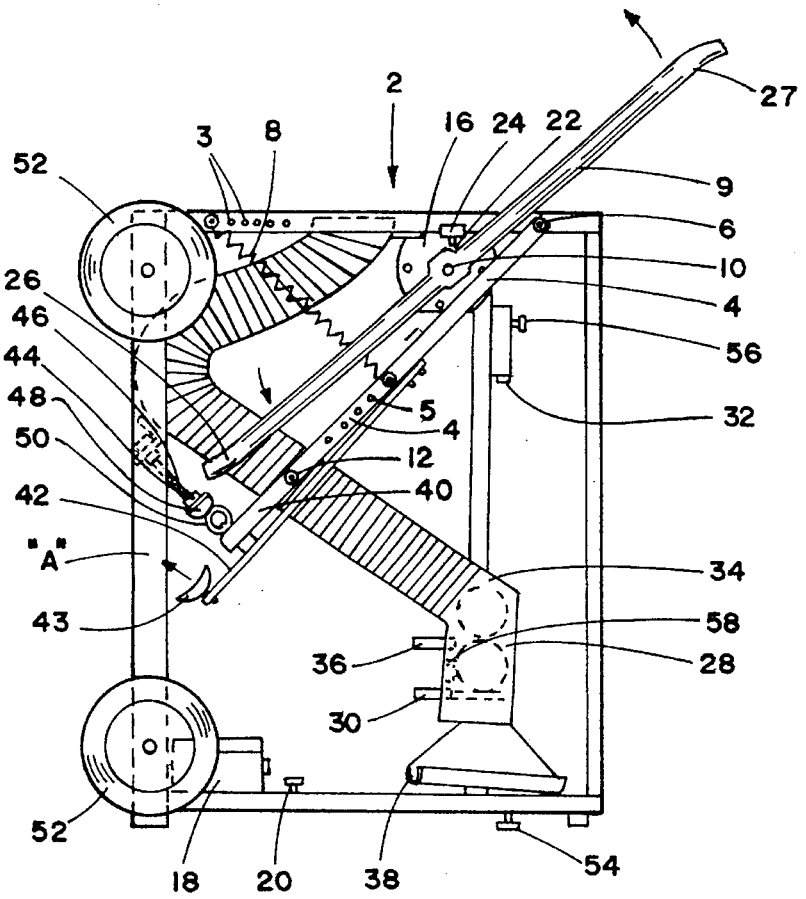
FIG. 1 is a side elevational view of the ball pitching device comprising the present invention showing the pitching arm in a pitching arm stop position and one of the rotary member ends in a pre-engaged position.
Figure 2:
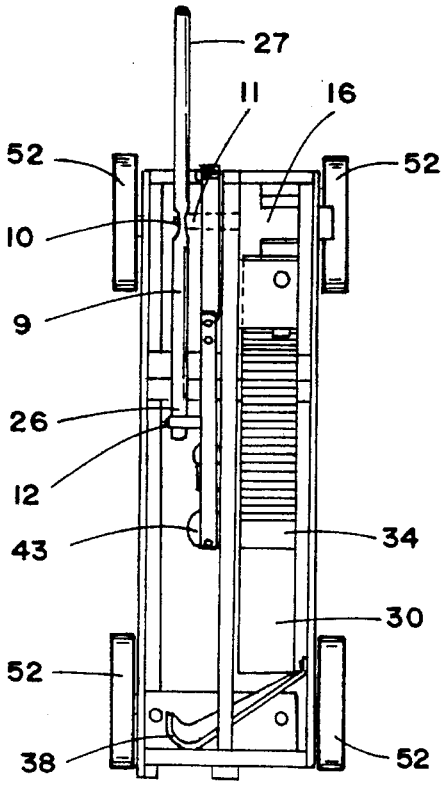
FIG. 2 is and end elevational view of the ball pitching device shown in FIG. 1.
Figure 4:
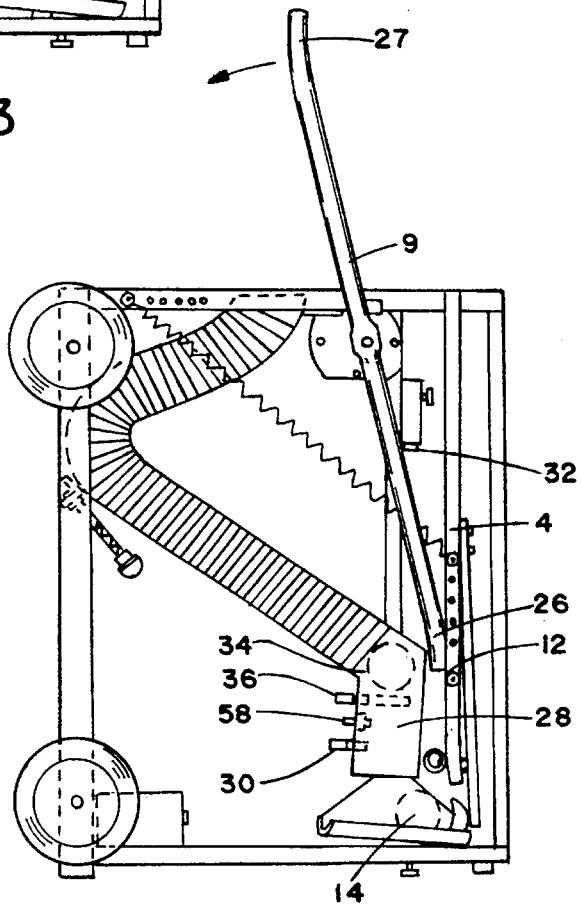
FIG. 4 is a side elevational view of the ball pitching device shown in FIG. 1 showing the pitching arm in a pitching arm ball engaging position.

Referring now to the drawings, and specifically to FIG. 1, a supporting frame shown generally as 2 has a pitching arm 4 pivoted to supporting frame 2 on a pitching arm pivot axis 6. Pitching arm 4 is pivotable between a stop position of pitching arm 4 as shown in FIG. 1 to a ball engaging position of pitching arm 4 as shown in FIG. 4. A tension spring 8 connected between pitching arm 4 and frame 2 urges pitching arm 4 in a ball pitching direction, illustrated by directional arrow "A" in FIG. 1, toward the pitching arm stop position. Pitching arm 4 is pivoted by a rotary member 9 rotatable on a rotation axis 10 spaced from pivot axis 6.

Figure 3:
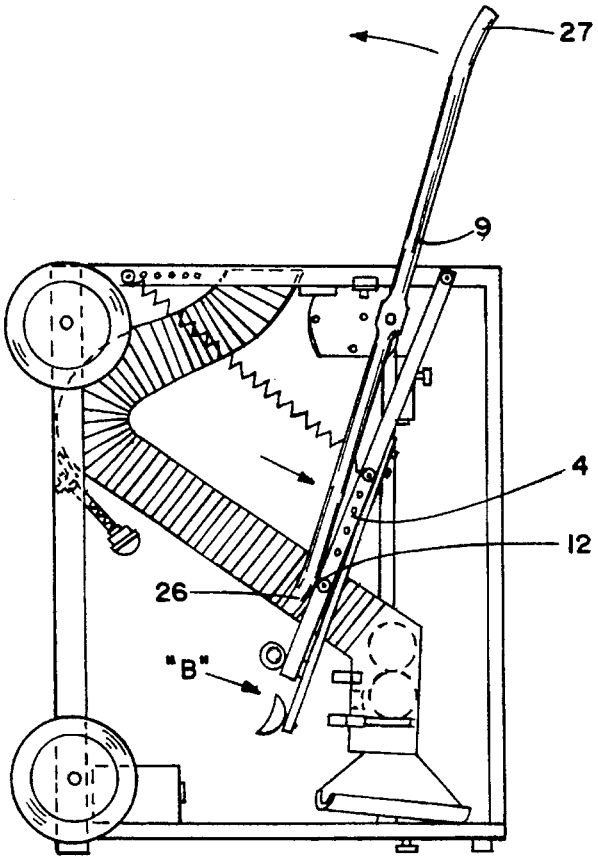
FIG. 3 is a side elevational view of the ball pitching device shown in FIG. 1 showing the pitching arm cam surface engaged by one of the rotary member ends.
Figure 5:
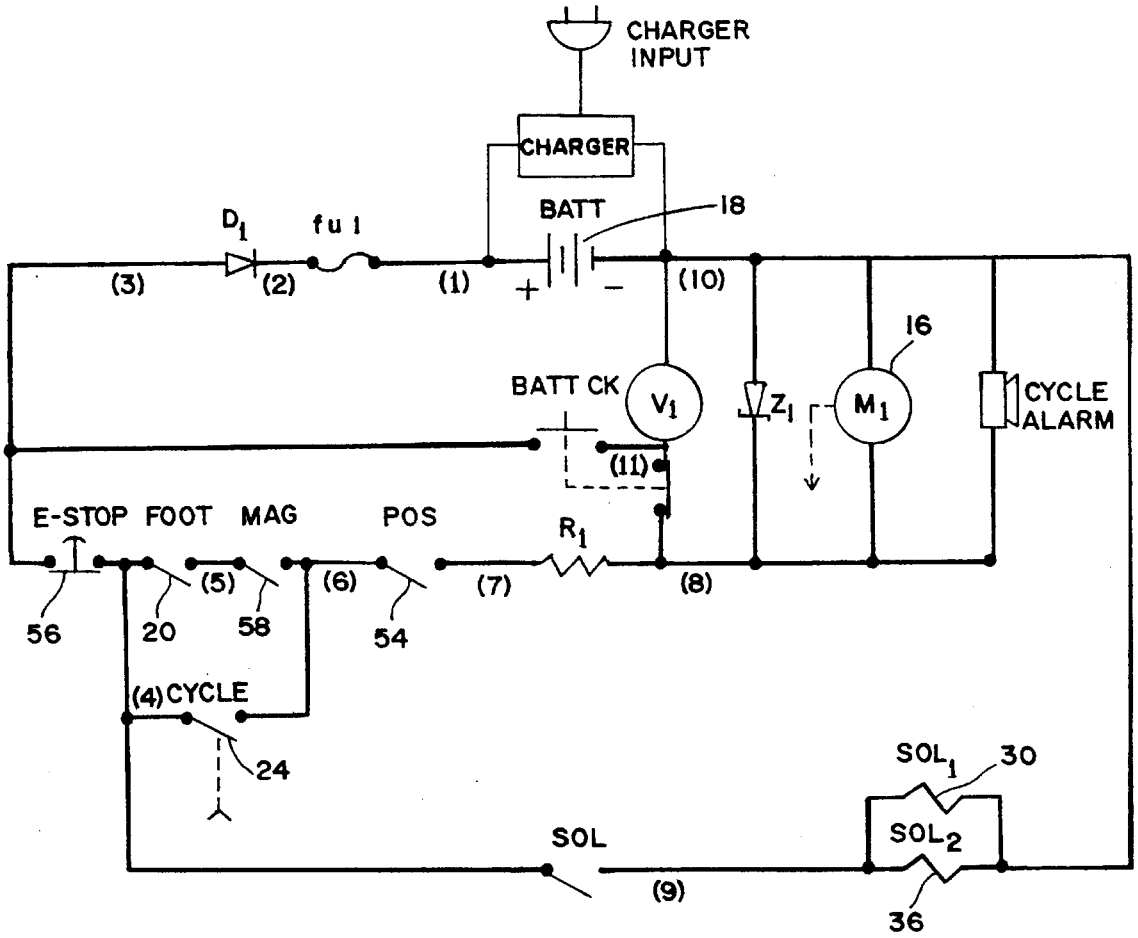
FIG. 5 is a simplified schematic diagram of the electric motor activating circuit for the ball pitching device comprising the present invention.

Pitching arm 4 is provided with a cam surface 12, and rotary member 9 engages pitching arm cam surface 12, as shown in FIG. 3, pivoting pitching arm 4 from the pitching arm stop position shown in FIG. 1 to the pitching arm ball engaging position shown in FIG. 4 for engagement of a ball 14 to be engaged and propelled in the ball pitching direction by pitching arm 4. Upon delivery of ball 14 for engagement by pitching arm 4, pitching arm 4 is released by rotary member 9, allowing tension spring 8 to return pitching arm toward the pitching arm stop position engaging and propelling ball 14 in the ball pitching direction. Rotary member 9 is rotated by an electric motor 16 provided with a rotation shaft 11, corresponding with rotation axis 10 of rotary member 9, to which rotary member 9 is connected, and electric motor 16 is powered by a battery 18 connected to electric motor 16 by an electric circuit shown in simplified schematic form in FIG. 5.

Electric motor 16 is activated initially by a manual switch 20 to rotate electric motor rotation shaft 11 and connected rotary member 9. The manual switch may be a foot operated switch spaced from and connected to the electric motor by an electric cable for remote operation. The manual foot operated switch is depressed and, after the rotating member commences rotating for approximately one-half second, the rotating member engages rotation responsive cycle switch 24 which keeps the electric motor activated and the rotating member rotating, and the foot switch may then be released. After rotating substantially 180 degrees, rotary member 9 disengages rotation responsive switch 24, which deactivates electric motor 16. Rotary member 9 has a pair of opposing rotary member ends 26, 27. Upon activation of electric motor 16, the electric motor rotation shaft 11 and connected rotary member 9 moves rotary member end 26 from a pre-engaged position of rotary member end 26 proximate pitching arm 4 in the pitching arm stop position, as shown in FIG. 1, to engage cam surface 12 of pitching arm 4 and pivot pitching arm 4 in a direction opposite the ball pitching direction, illustrated by arrow direction "B" as shown in FIG. 3, to the pitching arm ball engaging position as shown in FIG. 4.

A ball chamber 28 is supported on frame 2 for receiving and delivering a ball to be engaged by pitching arm 4 in the pitching arm ball engaging position shown in FIG. 4. Ball chamber 28 has an exit with a normally closed battery powered electric solenoid exit gate 30 normally retaining the ball received in ball chamber 28 as shown in FIG. 1. Ball chamber exit gate 30 is operable by a pitching arm pivotal movement responsive electrical switch 32 disposed to be engaged by pitching arm 4 in the pitching arm ball engaging position, as shown in FIG. 4, which activates exit gate 30 from a closed position to an open position allowing the ball to advance from ball chamber 28 for engagement by pitching arm 4 in the pitching arm ball engaging position.

As rotary member 9 continues to be rotated by electric motor rotation shaft 11, rotary member end 26 cams off and disengages pitching arm cam surface 12, releasing pitching arm 4 allowing tension spring 8 to return pitching arm 4 toward the pitching arm stop position engaging the ball to be pitched and propelling the ball in the ball pitching direction.

A ball magazine 34, communicating with ball chamber 28, receives one or more succeeding balls, as shown in FIG. 1, to be advanced to ball chamber 28. Ball chamber 28 is provided with an entrance having a normally open electric solenoid entrance gate 36, and a succeeding ball received in ball magazine 34 is normally retained against advancement to ball chamber 28 by the presence of a preceding ball which is retained in ball chamber 28 by normally closed exit gate 30 as shown in FIG. 1. Simultaneously with activation of exit gate 30 from a closed position to an open position to allow the preceding ball to advance from ball chamber 28 to be engaged by pitching arm 4, pivotal movement responsive electrical switch 32 activates entrance gate 36 from an open position to a closed position, retaining the succeeding ball in ball magazine 34.

When rotary member end 26 disengages pitching arm cam surface 12 releasing pitching arm 4, pitching arm pivotal movement responsive electrical switch 32 is likewise disengaged by pitching arm 4, deactivating ball chamber entrance gate 36 to the normally open position allowing the succeeding ball to advance from ball magazine 34 to ball chamber 28 and simultaneously deactivating ball chamber exit gate 30 to the normally closed position, retaining the succeeding ball in ball chamber 28.

After disengaging pitching arm 4, rotary member 9 continues to be rotated by rotation shaft 11 of electric motor 16 until rotary member 9 disengages rotation responsive cycle switch 24 to deactive electric motor 16, with the other of the opposing rotary member ends 27 disposed in a pre-engaged position proximate pitching arm 4 in the pitching arm stop position.

A channel member 38 having an arcuate inner surface is disposed proximate ball chamber 28 for receiving a ball to be pitched from ball chamber 28 for engagement by pitching arm 4. Pitching arm 4 is provided with a rigid arm portion 40 and spring arm portion 42 to enhance the propelling action of pitching arm 4. A pitching arm cup 43 having a concave inner surface is affixed to rigid arm portion 40 for engagement by pitching arm 4 of a ball to be pitched. A stop member 44 mounted on a compression spring 46 and having a rubber head 48 is affixed to frame 2 to be engaged by pitching arm 4 in the pitching arm stop position to absorb a portion of the shock generated when pitching arm 4 is returned by tension spring 8 to the pitching arm stop position. A pitching arm shock absorber 50 may also be affixed to pitching arm 4 to engage stop member 44 and absorb an addition portion of the shock so generated. To enable adjustment of the velocity in which the ball is propelled by pitching arm 4, a plurality of spaced holes 3 may be provided in frame 2, and a plurality of spaced holes 5 may be provided in pitching arm 4 for repositioning tension spring 8 relative to frame 2 and pitching arm 4 to increase or decrease the tension in tension spring 8.

In order to provide ease of transport and portability, frame 2 may be provided on one side with two pairs of opposing rotatable wheels 52 and enabling rolling movement of frame 2 on wheels 52 by turning frame 2 from an operable position as shown in FIGS. 1 through 4 onto the wheeled side in a transport position of frame 2. As a safety measure, a pressure activated switch 54 may be provided on the bottom of frame 2 in the operable position of frame 2, which normally overrides manual switch 20 to deactivate electric motor 16 unless frame 2 is in the operable position with pressure activated switch 54 depressed, preventing unintentional activation of electric motor 16. Additionally, an emergency stop switch 56 to deactivate electric motor 16 may be provided, and ball chamber 28 may be provided with a ball chamber switch 58 normally deactivating electric motor 16 unless a ball is disposed in ball chamber 28.

Obviously, any number of materials may be used to form the device of the present invention and its components described herein, and success has been experienced by the use of metal for the frame, pitching arm, and pitching arm spring, as well as certain other component parts, but other materials may be utilized which equal success.

With respect to the descriptions set forth above, optimum dimensional relationship for the parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principles of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A device for pitching balls comprising:

a supporting frame:

a pitching arm pivotally mounted on the supporting frame and movable between a first ball receiving position and a second ball projecting step, the pitching arm having a cam member and a cup for receiving a ball;

spring means urging the pitching arm toward said second position;

means supported on the frame for delivering a ball to the cup when the pitching arm is in said first position:

a rotary member rotatably supported on the supporting frame and having opposing ends;

an electric motor having a rotation shaft connected to the rotary member for rotating the rotary member, one of the opposing ends of the rotary member engaging the cam member of the pitching arm upon rotation of the rotary member and moving the pitching arm from said second position to the said first position for receiving the ball by the cup and thereafter releasing the cam member and allowing the spring means to cause the pitching arm to return to said second position; and a first electrical switch means manually operable to activate the electric motor and a second electrical switch responsive to rotation of the rotary member and operable by the rotary member to deactivate the electric motor after rotation of the rotary member substantially 180 degrees.

2. The device as claimed in claim 1, wherein said means for delivering a ball to the cup of the pitching arm comprising:

a ball chamber supported on the supporting frame; a channel member disposed proximate the ball chamber; and a ball magazine communicating with the ball chamber, the ball chamber having an entrance for receiving a ball from the ball magazine and an exit for allowing a ball to advance from the ball chamber to the channel member, the entrance having a normally open electric solenoid gate and the exit having a normally closed electric solenoid gate, the entrance and exit gates including electrical switch means responsive to movement of the pitching arm and operable by the pitching arm in said first position to activate the exit gate to an open position for allowing a ball to advance from the ball chamber to the channel member for delivery to the cup and simultaneously activate the entrance gate to a closed position for retaining a succeeding ball in the ball magazine.

3. The device as claimed in claim 2, said pitching arm having a rigid portion and a spring arm portion and said cup is mounted on the spring arm portion.

4. The device as claimed in claim 3, said spring means comprising a tension spring connected between said pitching arm and said frame.

5. The device as claimed in claim 4, further comprising stop means engageable by said pitching arm in said first position.

6. The device as claimed in claim 5, said stop means comprising a stop member affixed to said frame.

7. The device as claimed in claim 7, said stop member comprising a rubber head mounted on a compression spring.

8. The device as claimed in claim 7, said stop means further comprising a shock absorbing member affixed to said pitching arm.

* * * * *